United States Patent [19]

Patik

[11] 4,010,785

[45] Mar. 8, 1977

[54] PERSONAL CLOTHING BAG FOR WASHING MACHINE

[76] Inventor: Robert M. Patik, 823 Reservoir St., Mt. Pleasant, Pa. 15666

[22] Filed: Feb. 12, 1976

[21] Appl. No.: 657,633

[52] U.S. Cl. ..... 150/7; 229/62

[51] Int. Cl.[2] ..... B65D 33/24

[58] Field of Search ..... 150/3, 7; 229/62

[56] References Cited

UNITED STATES PATENTS

| | | | |
|---|---|---|---|
| 2,150,985 | 3/1939 | Plummer, Jr. | 150/3 |
| 2,392,034 | 1/1946 | Ellis et al. | 150/3 |
| 2,421,067 | 5/1947 | Howe | 150/3 |
| 2,543,299 | 2/1951 | Pritchard | 150/7 |
| 2,740,446 | 4/1956 | Roeckl | 150/3 |
| 2,789,610 | 4/1957 | Pritchard | 150/7 |
| 2,921,731 | 1/1960 | Volckening et al. | 150/3 X |
| 3,409,063 | 11/1968 | Pokras | 150/3 |

*Primary Examiner*—Stephen P. Garbe
*Attorney, Agent, or Firm*—Clarence A. O'Brien; Harvey B. Jacobson

[57] ABSTRACT

A generally rectangular bag is provided and constructed of mesh material. The bag is designed to receive personal clothing to be washed and to be placed in a washing machine for washing of the personal clothing therein while contained within the bag. The bag includes front and rear mesh panels of generally rectangular configuration with corresponding longitudinal edges of the panels secured together and one pair of corresponding end edges of the panels secured together. The other end edge of one of the panels includes an end extension flap which is folded back over the corresponding end marginal edge of the other panel and the opposite side edges of the flap are sewn to the corresponding longitudinal edges of the bag. In addition, the opposite end portions of the end marginal edges of the panels at the flap end of the bag and the corresponding overlying portions of the flap are secured together by sewing, thereby leaving only central portions of the end edges of the panels closed by the flap open for insertion of personal clothing into the bag beneath the flap and withdrawal of washed personal clothing from the bag.

4 Claims, 5 Drawing Figures

PERSONAL CLOTHING BAG FOR WASHING MACHINE

BACKGROUND OF THE INVENTION

Various forms of personal clothing bags for use in washing machines and other purposes have been heretofore designed. However, these previously known personal clothing bags have not been constructed to enable relative ease of insertion of clothing articles thereinto and the removal of clothing articles therefrom and yet with the bags fully operative to retain personal clothing items therein while the bag is being vigorously agitated in a washing machine.

Examples of clothing bags including some of the general structural features of the instant invention are disclosed in U.S. Pat. Nos. 2,543,299, 2,544,233, 2,602,482, 2,761,480, 2,842,179, 3,036,616, 3,339,606 and 3,655,118.

BRIEF DESCRIPTION OF THE INVENTION

The bag of the instant invention is generally rectangular in plan shape and includes a back folded flap at one end closing that end of the bag in a manner enabling personal clothing items to be inserted into the bag before washing and to be withdrawn from the bag after washing. However, the closure flap is constructed and attached to the remainder of the bag in a manner such that vigorous agitation of the bag and its contents within a washing machine will not result in personal clothing items within the bag being expelled therefrom.

The main object of this invention is to provide a personal clothing bag of mesh construction to be utilized for containing personal clothing while the bag and its contents are vigorously agitated within a washing machine.

Another object of this invention, in accordance with the immediately preceding object, is to provide a personal clothing bag into which personal clothing items may be readily inserted and from which those clothing items may be withdrawn after having been washed.

Yet another object of this invention is to provide a personal clothing bag for use in a washing machine and constructed in a manner whereby the personal clothing itmes within the bag will not be dislodged therefrom during the washing process.

A final object of this invention to be specifically enumerated herein is to provide a personal clothing bag for washing machines and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
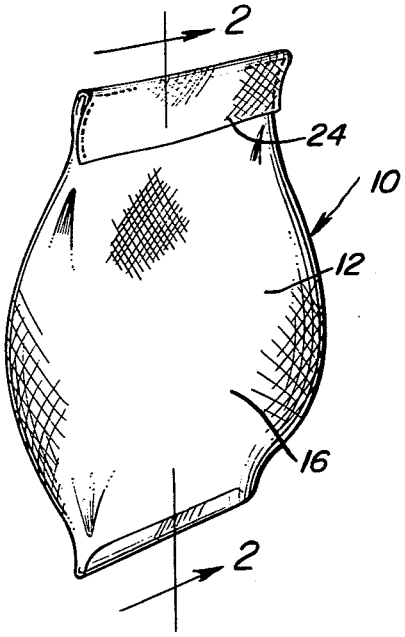
FIG. 1 is a perspective view of the personal clothing bag of the instant invention with a plurality of personal clothing items contained within the bag.

Referring now more specifically to the drawings, the numeral 10 generally designates the personal clothing bag of the instant invention. The bag 10 comprises a one-piece mesh panel 12 folded transversely as at 14 in order to form front and rear panels 16 and 18. The panels 16 and 18 include corresponding longitudinal edge portions secured together as by stitching 20 and 22 and the end of the rear panel 18 remote from the fold 14 includes an extension flap 24 which is folded back over the end marginal edge of the front panel 16 remote from the fold 14. Further, the opposite side edges of the end flap 24 are sewn to the corresponding end portions of the side marginal edges of the panels 16 and 18 by stitching 26 and the opposite end portions of the base marginal edge of the end flap 24 and the corresponding underlying opposite end portions of the end marginal edges of the panels 16 and 18 remote from the fold 14 are secured together by means of stitching 28.

Figure 2:
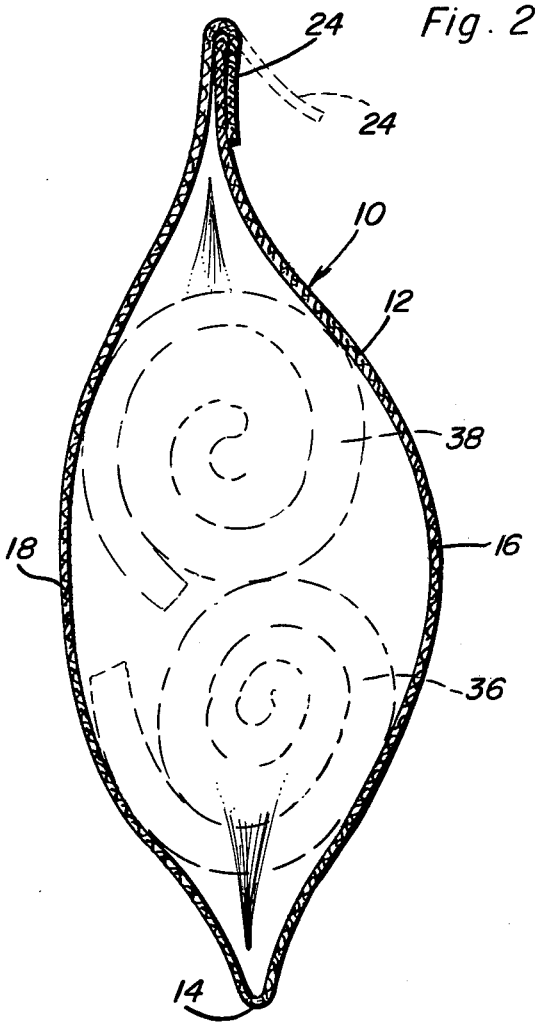
FIG. 2 is an enlarged fragmentary sectional view, taken substantially upon the plane indicated by the section line 2—2 of FIG. 1, and with an open position of the closure flap at one end of the bag illustrated in phantom lines.
Figure 3:
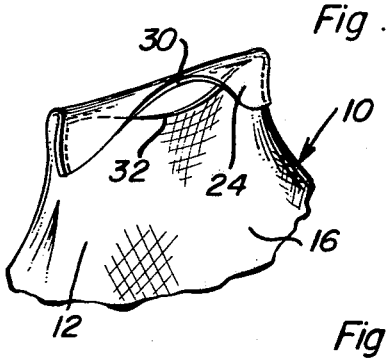
FIG. 3 is a fragmentary perspective view of the closure flap end of the bag and with the closure flap in an open position enabling personal clothing items to be inserted into or withdrawn from within the bag.
Figure 4:
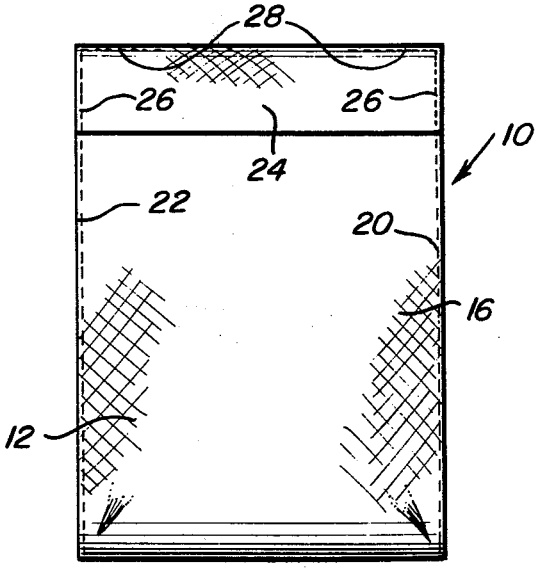
FIG. 4 is a plan view of the bag.
Figure 5:
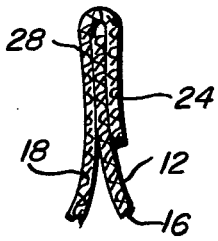
FIG. 5 is an enlarged fragmentary vertical sectional view of the closure flap end of the bag illustrating the manner in which one end of the base edge portion of the closure flap is secured to the underlying panel portions of the bag by stitching.

When the bag 10 is empty it assumes a flatened condition of substantially rectangular plan shape, such as that illustrated in FIG. 4 of the drawings. When it is desired to insert articles of personal clothing within the bag 10, the central portion 30 of the flap 24 is raised and the underlying central portion 32 of the front panel 16 is pulled out from beneath the flap 24 to thereby form an opening into the interior of the bag 10. After the desired personal clothing items have been inserted within the bag 10, the central portion 32 of the end marginal portion of the front panel 16 remote from the fold 14 is pushed back under the central portion 30 of the extension flap 24 and the latter is allowed to lay in a substantially flattened condition over the previously open end of the bag in the manner illustrated in FIG. 1 and in solid lines in FIG. 2.

Then, if it is desired to wash the personal clothing items 36 and 38 within the bag 10, the bag 10 is placed within a washing machine and washed in the conventional manner. After the washing cycle has been completed, the central portion 30 of the flap 24 is again lifted in order that the central portion 32 may be withdrawn from under the flap 24 to again open the central portion of the corresponding end of the bag 10 to allow the personal clothing items 36 and 38 to be withdrawn therefrom.

The stitching 28 is important to prevent smaller personal clothing items from being expelled from within the bag 10 as the latter and its contents are vigorously agitated in a washing machine. Further, the mesh construction of the panel 12 may be of any desired size and the panel 12 may be constructed of nylon or any other suitable material.

Because of the manner in which the extension flap 24 is sewn in position at 26 and 28, it is substantially impossible for articles of personal clothing to be expelled from the bag 10 while in a washing machine.

Further, it is to be noted that the bag 10 has been specifically designed to have articles of soiled clothing (socks, hosiery and other small articles) of one person placed therein for washing in a washing machine in order to prevent those articles from becoming mixed with other clothing articles in the washing machine.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A personal clothing bag for washing machines, said bag including front and rear mesh panel portions including pairs of registered corresponding marginal edge portions, all of said pairs of corresponding marginal edge portions, except one pair, being secured together, one of said panel portions including an outward extension flap extending along and projecting outwardly of the marginal edge portion thereof comprising one of said one pair of corresponding edge portions, said extension flap being folded back over the outer side of the other marginal edge portion of said one pair of edge portions and including opposite marginal edges overlying, extending along, and sewn to the end portions of second and third pairs of corresponding marginal edge portions of said panel portions between which said one pair of corresponding marginal edge portions extend, the corresponding opposite end portions of said one pair of corresponding marginal edge portions and the overlying portions of said extension flap being sewn together inwardly therealong from said second and third pairs of edge portions to the opposite ends of central portions of said one pair of edge portions and with said central portions of said one pair of edge portions and the corresponding overlying portion of said flap being free of connections with each other.

2. The combination of claim 1 wherein said panel portions are generally rectangular in plan shape.

3. The combination of claim 2 wherein said one pair of corresponding marginal edge portions of said panel portions comprise corresponding end edge portions thereof.

4. The combination of claim 3 wherein said panel portions are constructed from a single elongated rectangular mesh panel transversely folded adjacent its longitudinal mid-portion with the folded portion of said single mesh panel joining the corresponding marginal edges of said front and rear panel portions remote from said one pair of corresponding marginal edge portions thereof.

* * * * *